US007291102B2

(12) United States Patent
Mackert et al.

(10) Patent No.: US 7,291,102 B2
(45) **Date of Patent: *Nov. 6, 2007**

(54) MULTI-PURPOSE EXERCISE METHODS AND APPARATUS

(76) Inventors: Ross A. Mackert, 1500 Jackson St. NE., #443, Minneapolis, MN (US) 55413; Mark A. Krull, P.O. Box 7198, Bend, OR (US) 97708; Dale R. Henn, 1500 Jackson St. NE., #443, Minneapolis, MN (US) 55413; Neal P. Barnes, 1500 Jackson St. NE., #443, Minneapolis, MN (US) 55413

( * ) Notice: Subject to any disclaimer, the term of this patent is extended or adjusted under 35 U.S.C. 154(b) by 0 days.

This patent is subject to a terminal disclaimer.

(21) Appl. No.: 11/439,370

(22) Filed: May 23, 2006

(65) Prior Publication Data

US 2007/0010382 A1 Jan. 11, 2007

Related U.S. Application Data

(63) Continuation of application No. 10/292,386, filed on Nov. 8, 2002, now Pat. No. 7,048,677, which is a continuation-in-part of application No. 09/549,314, filed on Apr. 13, 2000, now Pat. No. 6,491,610.

(60) Provisional application No. 60/129,088, filed on Apr. 13, 1999.

(51) Int. Cl.
*A63B 21/04* (2006.01)

(52) U.S. Cl. ..... 482/130; 482/121; 482/123

(58) Field of Classification Search ..... 482/25, 482/130, 121, 123, 98, 99–102
See application file for complete search history.

(56) References Cited

U.S. PATENT DOCUMENTS

| | | | | |
|---|---|---|---|---|
| 4,603,855 | A | 8/1986 | Sebelle | 482/103 |
| 4,898,381 | A | 2/1990 | Gordon | 482/103 |
| 4,988,095 | A | 1/1991 | Ferrari | 482/102 |
| 5,362,296 | A | 11/1994 | Wang et al. | 482/133 |
| 5,674,197 | A | 10/1997 | van Muiden et al. | 604/95.04 |
| 6,102,836 | A | 8/2000 | Person | 482/103 |
| 6,217,493 | B1 | 4/2001 | Spletzer | 482/103 |
| 6,491,610 | B1 * | 12/2002 | Henn | 482/130 |
| 7,048,677 | B2 * | 5/2006 | Mackert et al. | 482/102 |

* cited by examiner

*Primary Examiner*—Lori Amerson

(57) ABSTRACT

An exercise apparatus includes a floor engaging base, a vertical stanchion, and at least one body support. Cables are interconnected between respective handles and respective pivot arms. At least one resistance device is interconnected between the pivot arms and the frame. The cables are routed about pulleys on the frame in a manner that facilitates different types of exercise motions. Adjustments to resistance may be made by repositioning at least one of the cables and the resistance device relative to the pivot arms.

20 Claims, 15 Drawing Sheets

MULTI-PURPOSE EXERCISE METHODS AND APPARATUS

CROSS-REFERENCE TO RELATED APPLICATIONS

This is a continuation of U.S. patent application Ser. No. 10/292,386, filed Nov. 8, 2002 (U.S. Pat. No. 7,048,677), which is a continuation-in-part of U.S. patent application Ser. No. 09/549,314, filed Apr. 13, 2000 (U.S. Pat. No. 6,491,610), which discloses subject matter entitled to the filing date of U.S. Provisional Application No. 60/129,088, filed Apr. 13, 1999.

FIELD OF THE INVENTION

The present invention relates to exercise equipment and more specifically, to a multi-purpose exercise apparatus.

BACKGROUND OF THE INVENTION

Many types and variations of exercise equipment are known in the art. The "home gym" is a well recognized category of exercise equipment. Generally speaking, this type of product is intended to provide a variety of exercises on a single piece of equipment which is relatively compact and affordable.

SUMMARY OF THE INVENTION

The present invention provides a multi-purpose exercise apparatus which strikes a desirable balance between the cost of manufacture and both the quantity and quality of available exercises. Many of the features and/or advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the views.

DETAILED DESCRIPTION OF A PREFERRED EMBODIMENT

Figure 1:
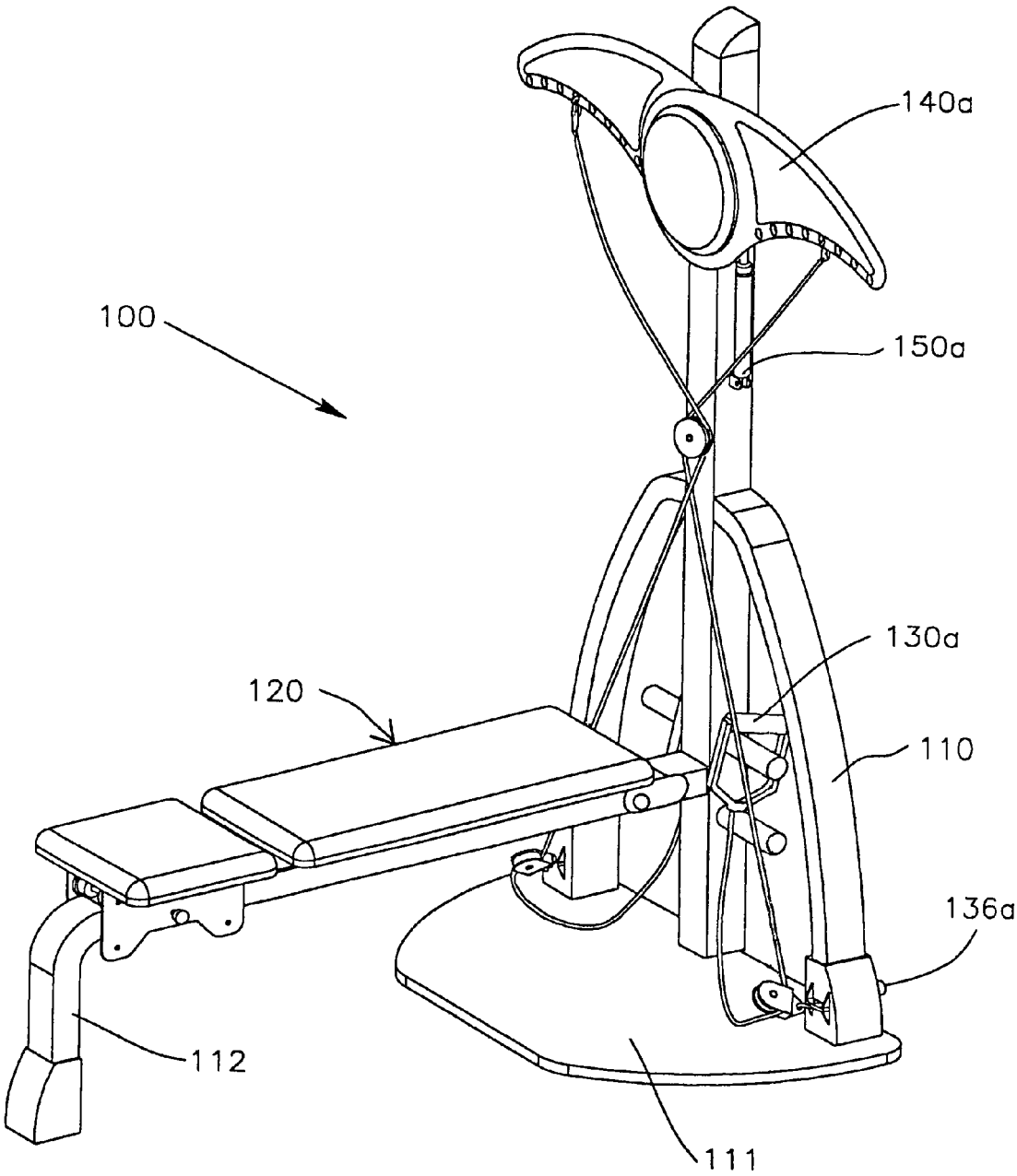
FIG. 1 is a perspective view of a first exercise apparatus constructed according to the principles of the present invention.

A first exercise apparatus constructed according to the principles of the present invention is designated as 100 in FIGS. 1-6. The apparatus 100 generally includes a frame 110, a bench 120, force receiving members 130*a-b*, force transmitting members 140*a-b*, flexible connectors 133*a-b* interconnected between respective force receiving members 130-*b* and respective force transmitting members 140*a-b*, and force resistance members 150*a-b* interconnected between respective force transmitting members 140*a-b* and the frame 110.

The frame 110 includes a floor engaging platform or base 111, and a vertical post or stanchion 114 that extends perpendicularly upward from the platform 111. The platform 111 is sized and configured to support the apparatus 100 in a vertical or upright orientation, and to support the feet of a standing person.

Left and right rails 113*a* and 113*b* extend upward from opposite sides of the platform 111 and toward an intermediate portion of the stanchion 114. The rails 113*a* and 113*b* cooperate to define a generally parabolic shape and may be described both as upwardly convergent and as inclined relative to the underlying floor surface.

The bench 120 includes central, L-shaped rail 112 having a first end that is connected to the stanchion 114, between the platform 111 and the tops of the rails 113*a* and 113*b*, and an opposite, second end that is configured and arranged to rest upon the underlying floor surface. The rail 112 is releasably secured to the stanchion 114 be means of a fastener 118 extending through aligned holes in the rail 112 and a support extending outward from the stanchion 114. The bench 120 is also pivotal about the fastener 118 for pivoting between a horizontal, operative position, shown in the drawing, and a vertical, storage position (not shown).

Figure 5:
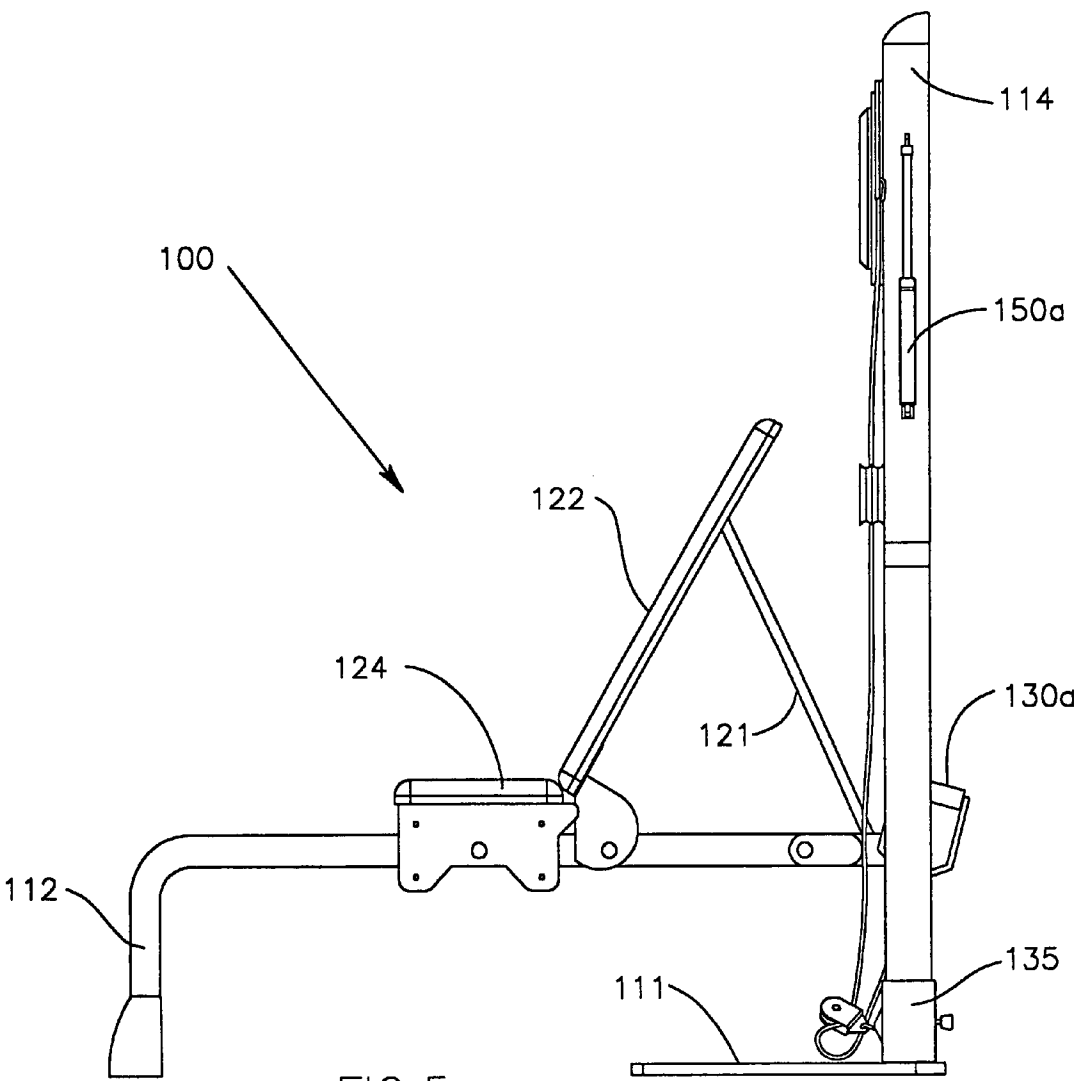
FIG. 5 is a side view of the exercise apparatus of FIG. 1 in a second configuration.

The bench 120 includes a back supporting member 122 which is mounted on the rail 112 and selectively movable relative thereto. A detent pin 123 or other suitable fastener selectively secures the back supporting member 122 in place relative to the rail 112. As shown in FIG. 5, a brace 121 is pivotally mounted on the back supporting member 122 and folds from underneath same to selectively support the back supporting member 122 in an inclined orientation relative to the rail 112.

Figure 6:
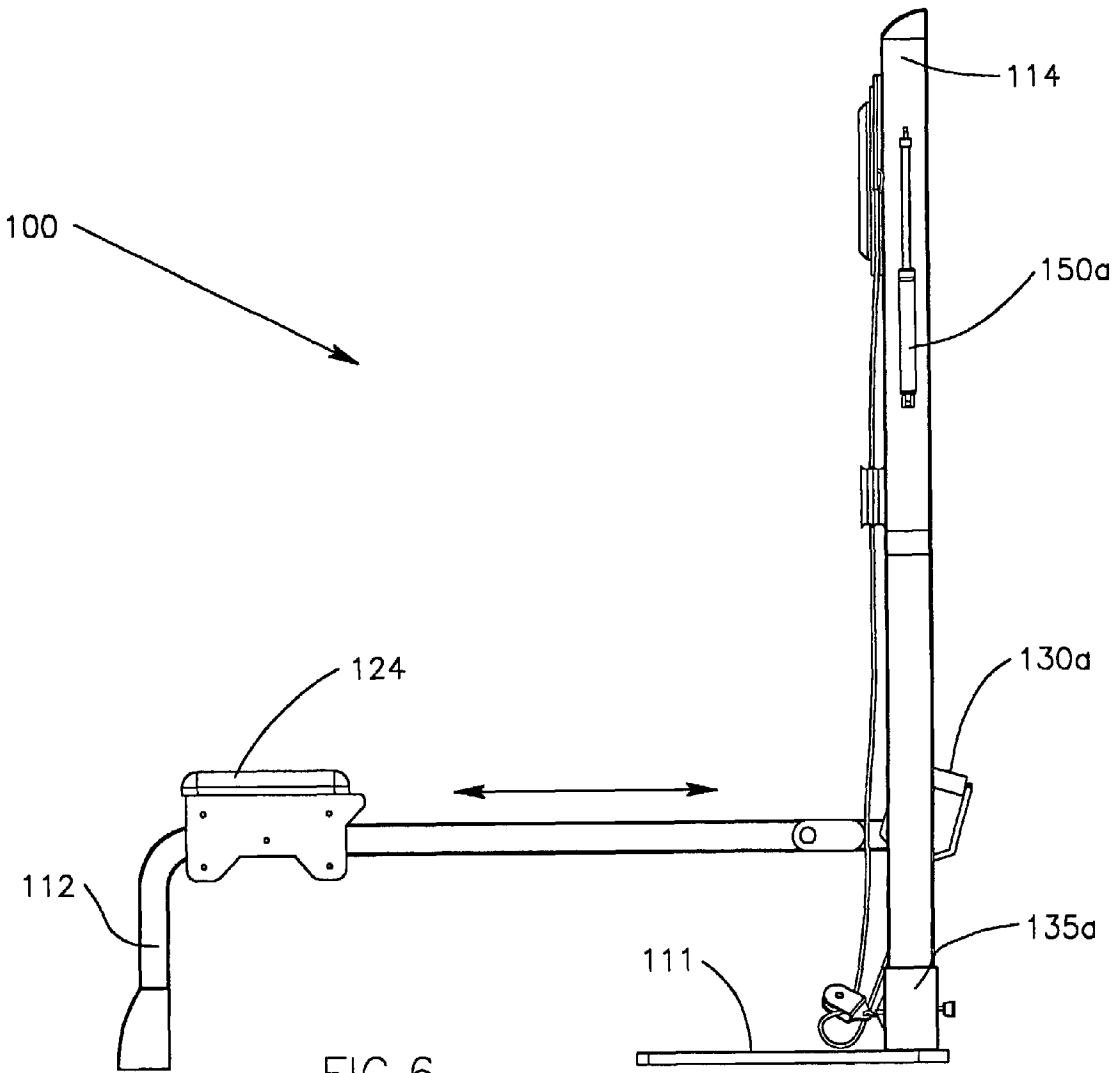
FIG. 6 is a side view of the exercise apparatus of FIG. 1 in a third configuration.

The bench 120 also includes a seat 124 which is mounted on the rail 112 and selectively movable relative thereto. In particular, rollers are rotatably mounted on the seat 123 and bear against the rail 112. A detent pin 125 or other suitable fastener is inserted through aligned holes in the seat 124 and the rail 112 in order to selectively secure the former in place relative to the latter. As shown in FIG. 6, the back supporting member 122 may be removed from the rail 112 to permit reciprocal movement of the seat 124 back and forth along the rail 112 (as suggested by the arrows).

Figure 2:
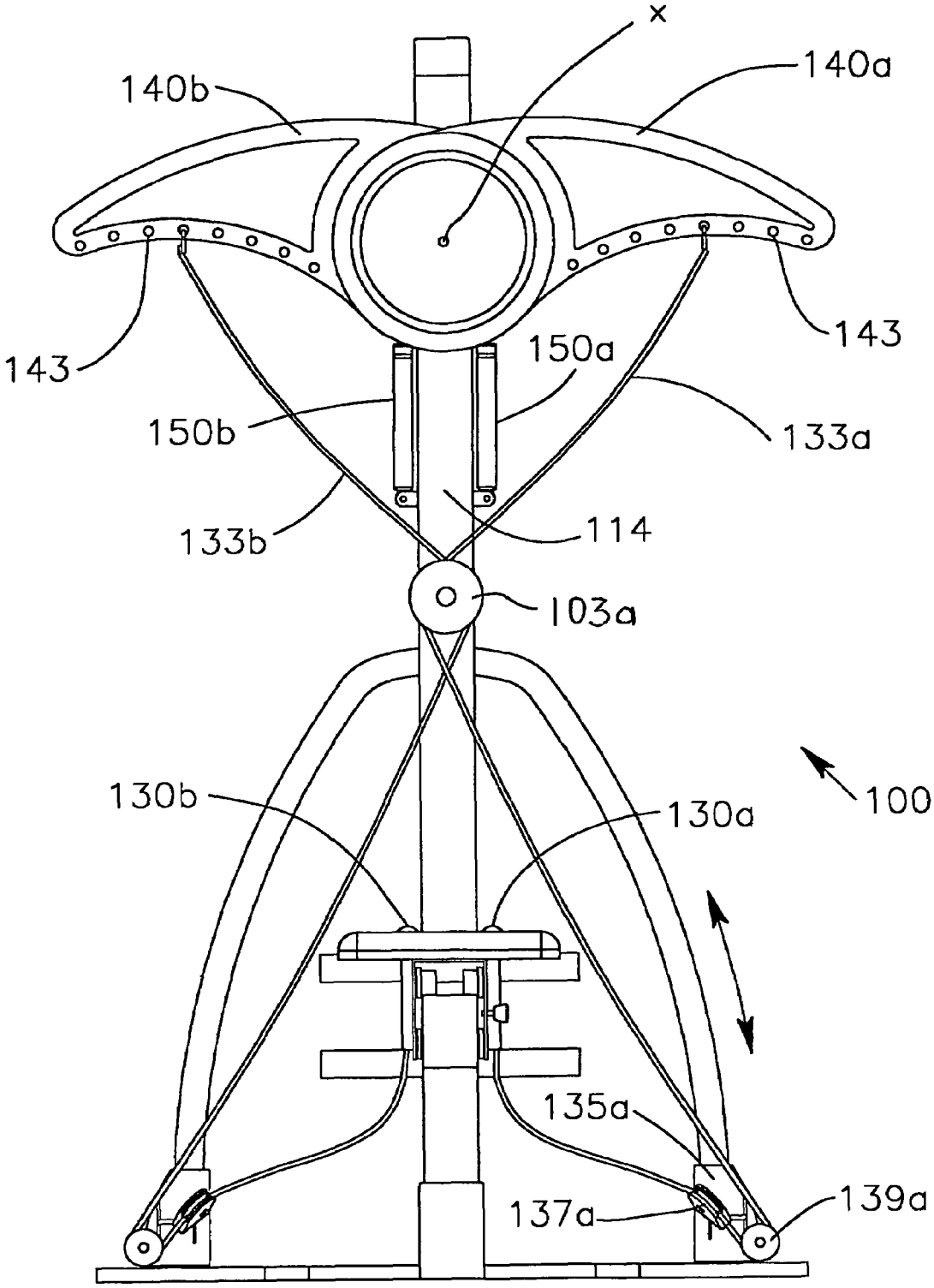
FIG. 2 is a front view of the exercise apparatus of FIG. 1.
Figure 3:
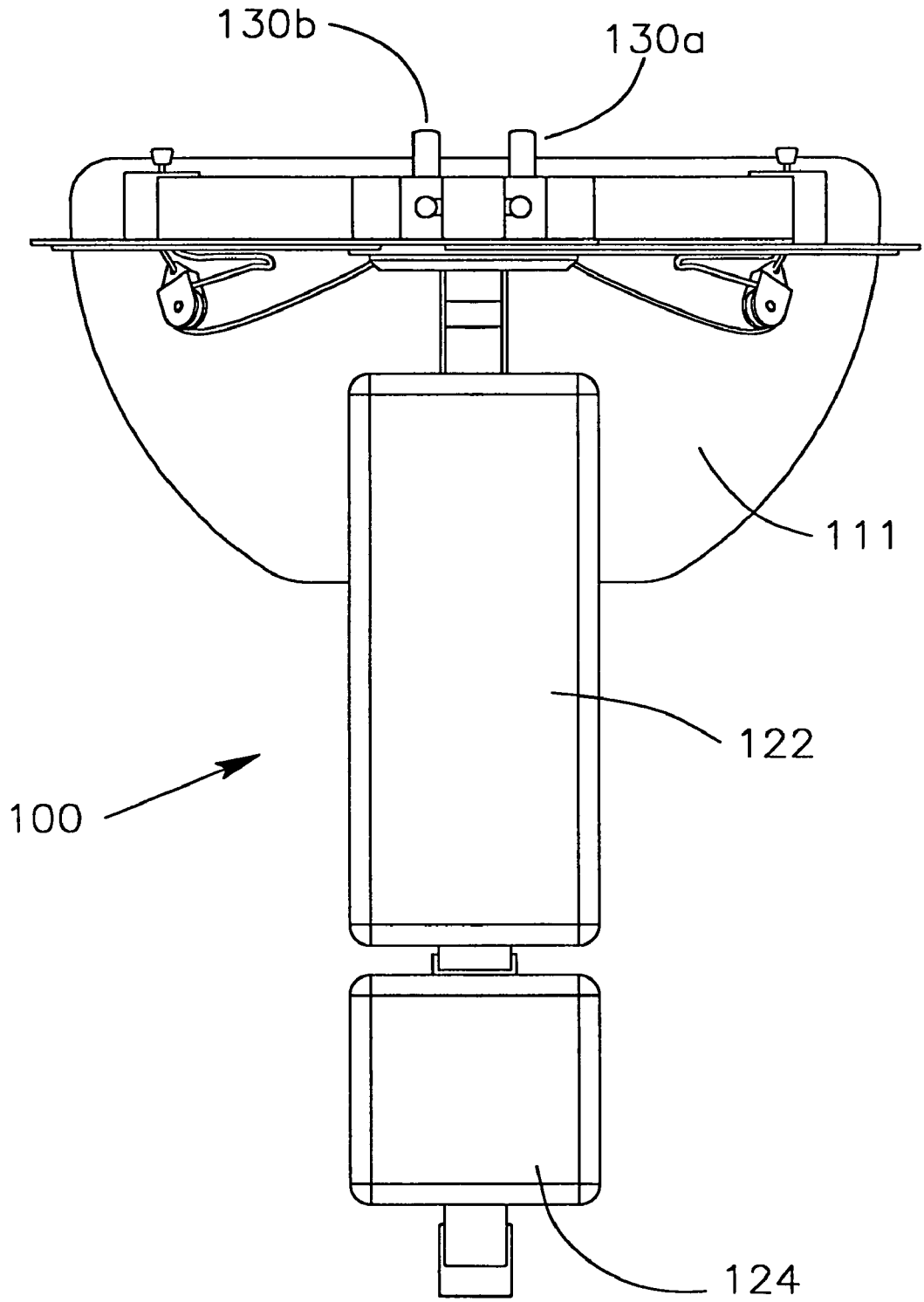
FIG. 3 is a top view of the exercise apparatus of FIG. 1.
Figure 4:
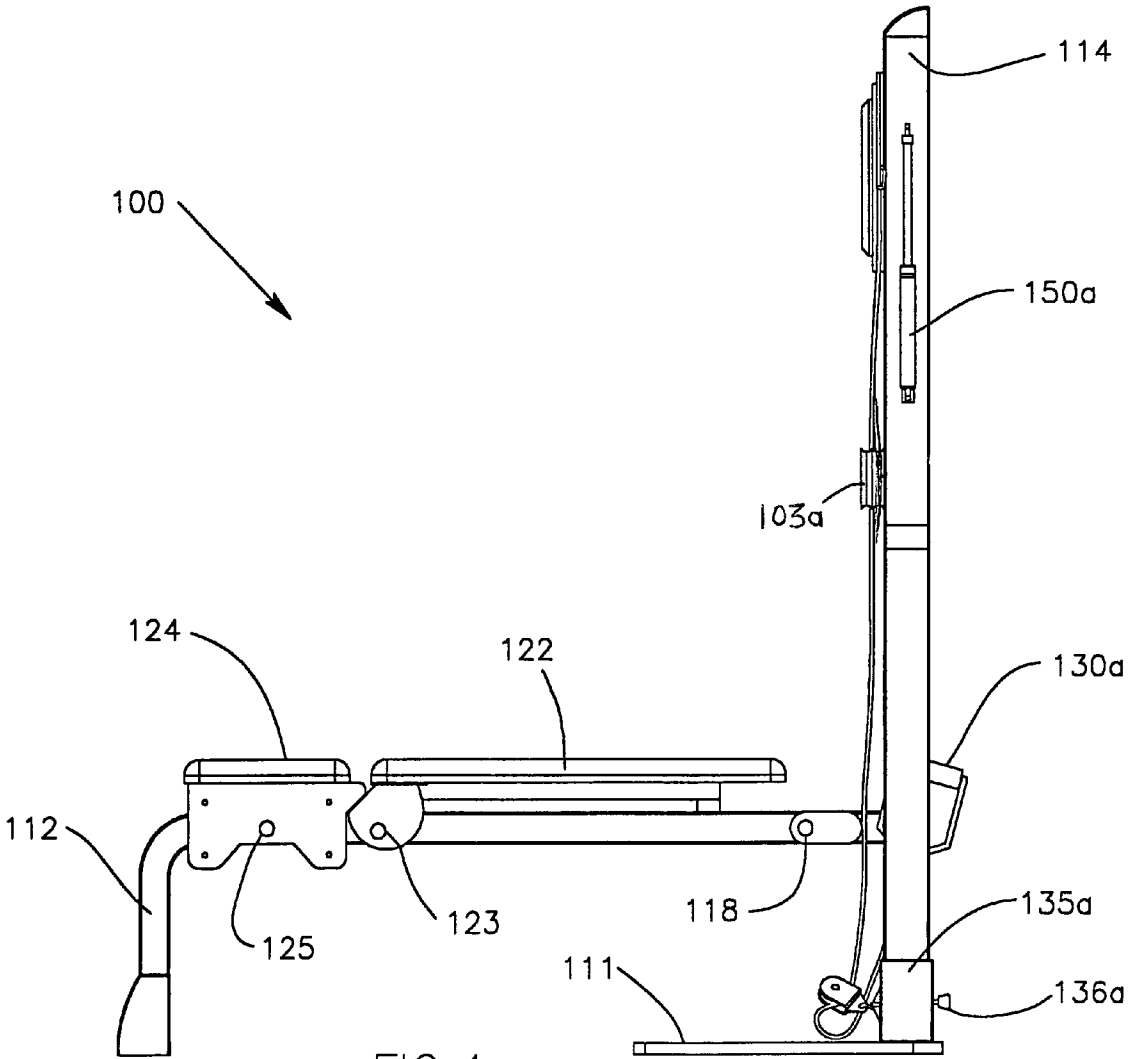
FIG. 4 is a side view of the exercise apparatus of FIG. 1.

FIG. 2 shows one way to connect the force receiving members 130*a* and 130*b* to the force transmitting members 140*a* and 140*b*. With reference to the right side of the apparatus 100, for example, a bracket 135*a* is mounted on the rail 113*a* and selectively movable relative thereto (as suggested by the arrows). A detent pin 136*a* (shown in FIGS. 1 and 4) or other suitable fastener inserts through the bracket 135*a* and any of several holes in the rear side of the rail 113*a* to selectively secure the bracket 135*a* in any of several positions along the rail 113*a*. A first pulley 137*a* or other suitable guide is operatively mounted on the bracket 135*a*. A second pulley 139*a* or other suitable guide is operatively mounted on the frame 110 on or near the platform 114. The flexible cable 133*a* is connected to the force receiving member 130*a*, and then routed sequentially about the pulley 137*a*, the pulley 139*a*, and the pulley 103*a*, and then routed to the force transmitting member 140*a*. Counterpart pulleys are provided for the other flexible cable 133*b*.

As shown in FIGS. 1 and 3-6, the apparatus 100 may alternatively be constructed without the fixed pulleys 139*a*. In any event, the pulley 137*a* may be relocated along the rail 113*a* to accommodate different types of exercises and/or different starting points, while the pulley 139*a* remains fixed to minimize slack in the cable 133*a* regardless of the location of the pulley 137*a*. For example, when the pulleys 137*a* and 137*b* are positioned proximate the floor, the apparatus 100 is configured for providing a "dead lift" exercise. At the other extreme, the pulleys 137*a* and 137*b* may be moved near the upper ends of respective rails 113*a* and 113*b* to facilitate a rowing exercise (with the apparatus 100 adjusted to the configuration shown in FIG. 6).

The upper end of the cable 133*a* is connected to the force transmitting member 140*a* via any of several holes 143 provided in same. The force transmitting member 140*a* is pivotally mounted on the stanchion 114 and rotatable relative thereto about a pivot axis X. A force resisting cylinder 150*a*, such as a gas spring or other suitable resistance mechanism, is movably interconnected between the force transmitting member 140*a* and the stanchion 114 to resist rotation of the former relative to the latter. On this embodiment 100, the cylinder 150*a* is configured to change length subject to a constant resistance force. Resistance to exercise is adjusted by relocating the cable 133*a* along the force transmitting member 140*a*, recognizing that the user's mechanical advantage increases as a function of distance from the pivot axis X.

A second exercise apparatus constructed according to the principles of the present invention is designated as 200 in FIGS. 7-11. The exercise apparatus 200 includes a frame 210 having a base or platform 211 designed to rest upon a floor surface 90 (see FIG. 11), and a post or stanchion 214 that extends upward from the base 211. The platform 211 is sized and configured to maintain the apparatus 200 in a stable position on the floor surface 99, and to accommodate the feet of a standing person. Left and right rails 213*a-b* extend upward and inward from respective sides of the platform 211 to an intermediate portion of the post 214. The rails 213*a-b* may be described as inclined and/or upwardly convergent relative to the floor surface. Wheels 201 are rotatably mounted on the platform 211 and tiltable into contact with the floor surface 90 to facilitate movement of the apparatus 200 across the floor surface 90.

Figure 11:
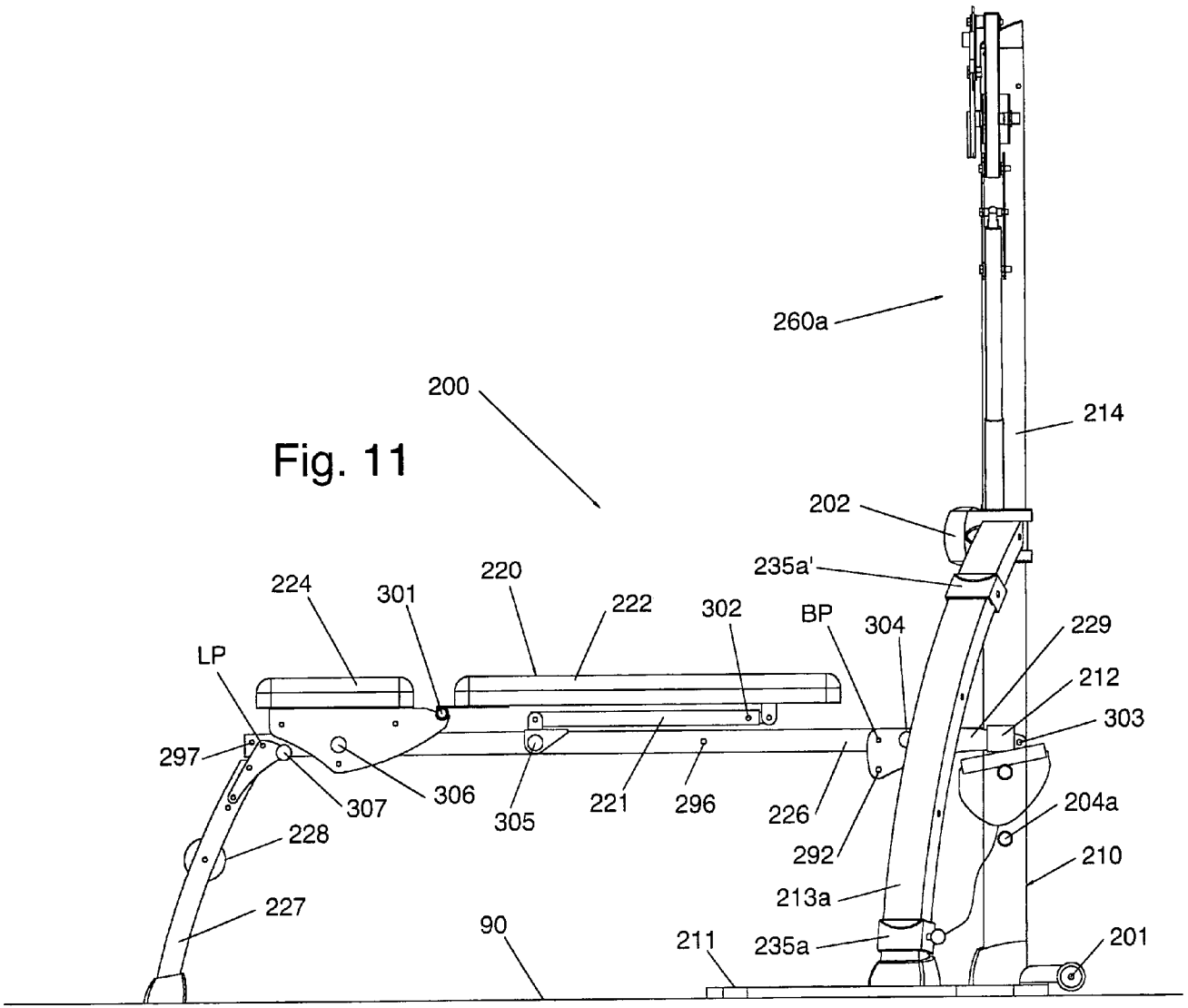
FIG. 11 is a side view of the exercise apparatus of FIG. 7.

With reference to FIG. 11, a bench 220 is releasably connected to the frame 210 and may be arranged to rest in part on the floor surface 90. In this regard, C-shaped sleeves 212 are mounted on opposite sides of the post 214, approximately midway between the platform 211 and a juncture defined by the rails 213*a-b* and the post 214. A bracket 229 has left and right distal ends that are inserted through respective sleeves 212 and secured to the post 214 by means of a detent pin 303 or other suitable fastener. The bench 220 includes a rail 226 having a first end that is pivotally connected to an opposite end of the bracket 229 for pivoting about a pivot axis BP. The rail 226 is pivotal between a generally horizontal, operative orientation (shown in FIG. 11), and a generally vertical, storage orientation (extending parallel to the post 214). A detent pin 304 or other suitable fastener is inserted through a respective hole (one of which is designated as 292 in FIG. 11) in the bracket 229 and an alignable hole in the rail 226 to secure the rail 226 in either orientation.

A leg 227 has a first end that is pivotally connected to an opposite, second end of the rail 226 for pivoting about a pivot axis LP. An opposite, second end of the leg 227 is configured to rest on the floor surface 90. The leg 227 is pivotal between an operative position, extending generally perpendicular to the rail 226 (as shown in FIG. 11), and a storage position, extending generally parallel to the rail 226. A detent pin 307 or other suitable fastener is inserted through a hole in a bracket portion of the leg 227 and through a respective, alignable hole in the rail 226 (one of which is designated as 297 in FIG. 11) to secure the rail 226 in either orientation. A slot extends through an intermediate portion of the leg 227, and a pulley 228 is rotatably mounted within the slot for reasons discussed below.

A seat 224 is rollably mounted on the rail 226 in a manner known in the art. A detent pin 306 or other suitable fastener is inserted through a bracket associated with the seat 224 and one of several alignable holes in the rail 226 to selectively lock the seat 224 in a desired location along the rail 226. The seat 224 is sized and configured to support the buttocks of a person in a seated position or a supine position. The seat 224 is selectively connected to a back support 222 by means of a snap button 301 or other suitable fastener projecting through aligned holes in respective brackets associated with the seat 224 and the back support 222.

The back support 222 is sized and configured to support the back of a person in a seated position on the seat 224 or in a supine position with his/her buttocks on the seat 224. An end of the back support 222 opposite the seat 224 is selectively connected to the rail 226 by means of telescoping assembly 221 and a relocatable bracket. The assembly 221 is pivotally interconnected between the back support 222 and the bracket, and the length of the assembly 221 is adjusted by means of a snap button 302 or other suitable fastener projecting through aligned holes in the rod and cylinder portions of the assembly 221. The bracket is selectively connected to the rail 226 by means of a detent pin 305 or other suitable fastener inserted through the bracket and one of several alignable holes 296 in the rail 226.

Right and left force transmitting members or pivot arms 240*a-b* are pivotally mounted on the post 214, proximate an upper end thereof, and are pivotal through respective paths on respective sides of the post 214. One of the associated pivot axes is designated as TP in FIG. 9. Each force transmitting member 240*a-b* may be described in terms of a pivot end, an opposite, distal end, and an intermediate portion disposed therebetween. A distal end of a respective cord 233*a-b* or other suitable flexible connector is connected to the distal end of a respective force transmitting member 240*a-b* by means of a respective carabiner 243 or other suitable fastener.

Right and left resistance mechanisms 260*a-b* are interconnected between the post 214 and the intermediate portions of respective force transmitting members 240*a-b*. On this embodiment 200, each resistance mechanism 260*a-b* includes a first link 251*a-b* having a first end pivotally connected to the post 214 for pivoting about a respective pivot axis RP, and an opposite, second end pivotally connected to a lower end of a respective second link 252*a-b*. An opposite, upper end of each second link 252*a-b* is pivotally connected to the intermediate portion of a respective force transmitting member 240*a-b*. As further explained below, the upper ends of the second links 252*a-b* are selectively adjustable along respective force transmitting members 240*a-b*. Each resistance mechanism 260*a-b* also includes a gas spring 250*a-b* or other suitable resilient device having a lower end pivotally connected to the post 214 for pivoting about a respective pivot axis SP, and an opposite, upper end pivotally connected to an intermediate portion of a respective first link 251*a-b*. The pivot axes SP are located just beneath the junctures between the rails 213*a-b* and the post 214.

Figure 8:
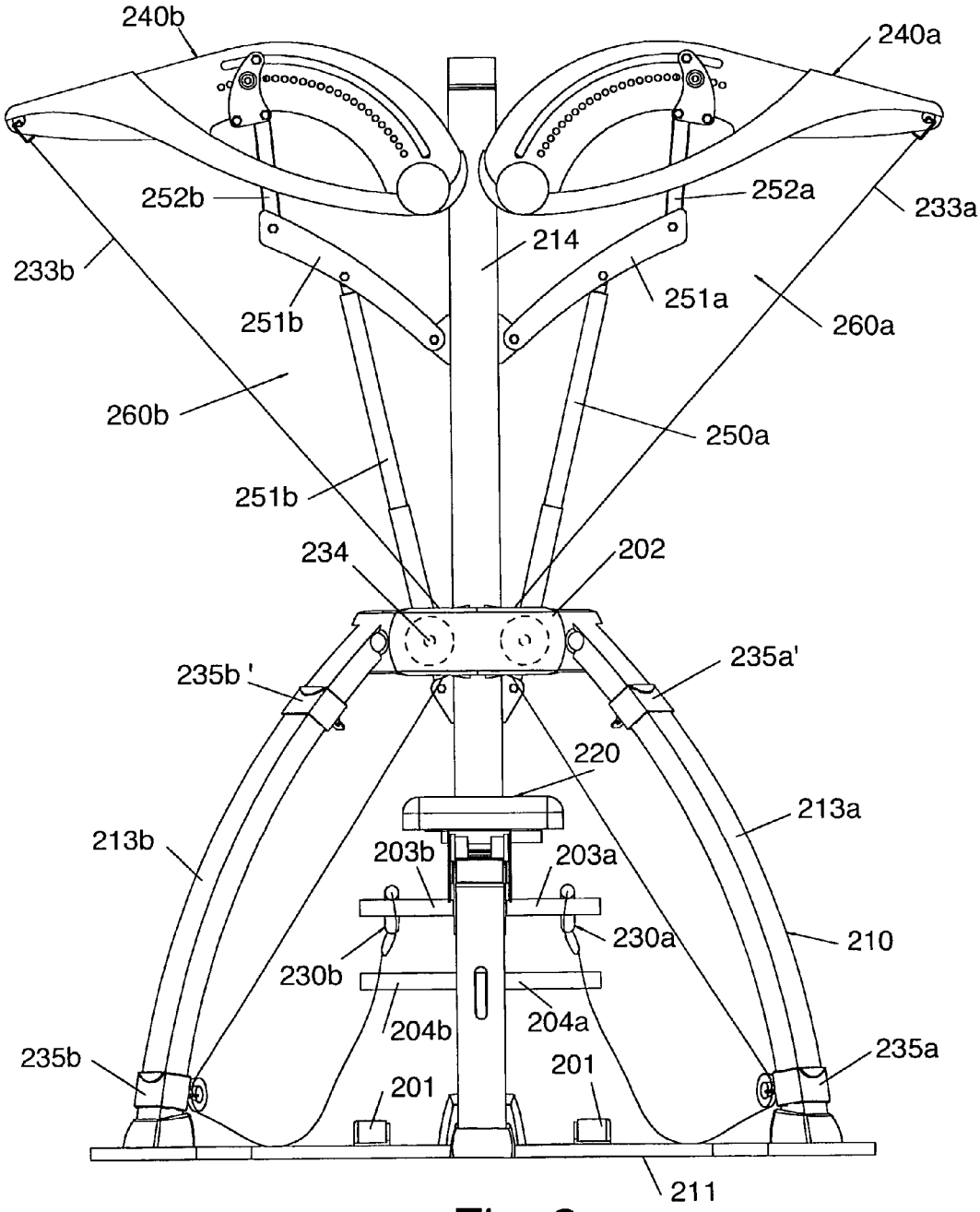
FIG. 8 is a front view of the exercise apparatus of FIG. 7.
Figure 9:
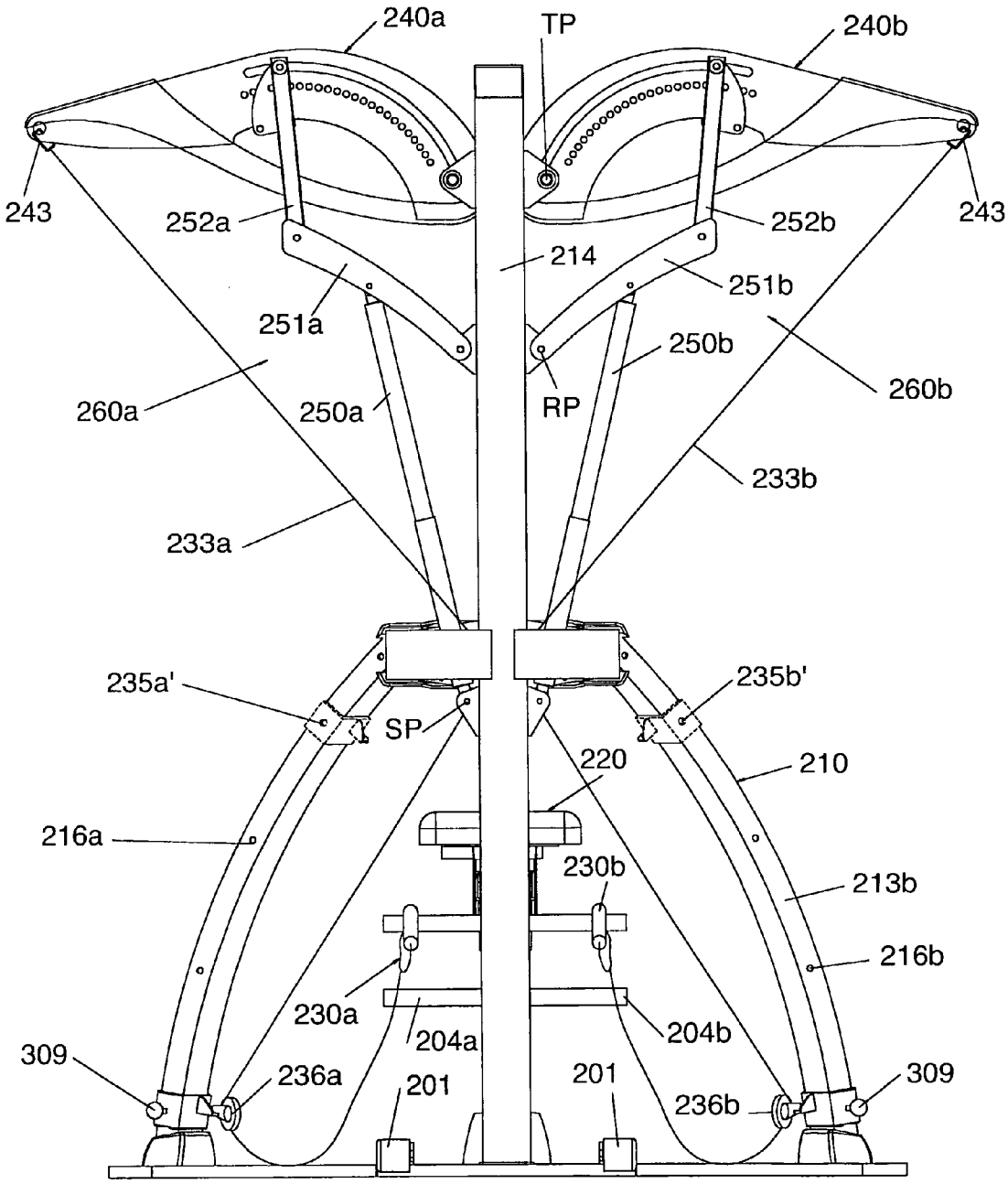
FIG. 9 is a rear view of the exercise apparatus of FIG. 7.
Figure 10:
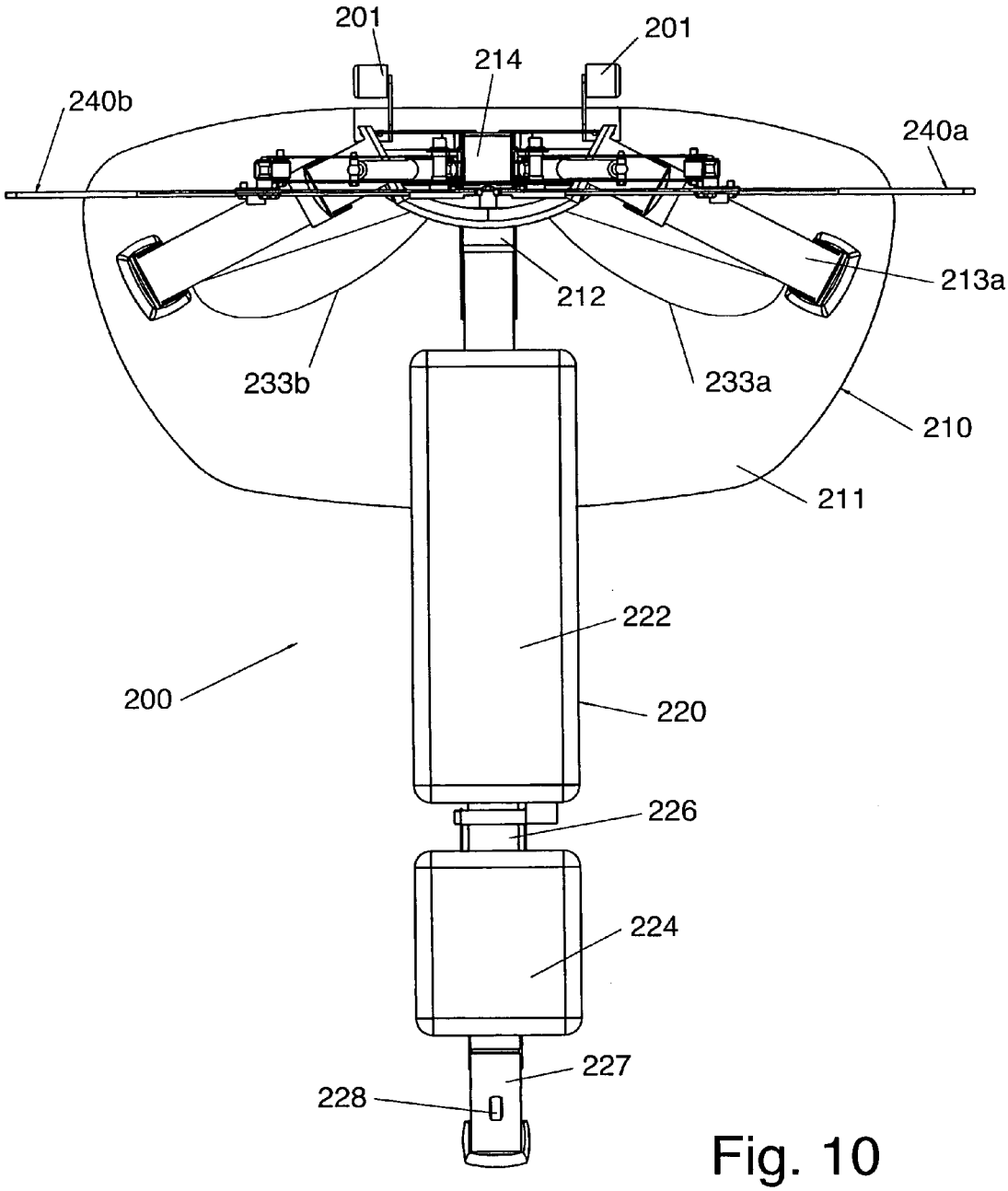
FIG. 10 is a top view of the exercise apparatus of FIG. 7.

The resistance mechanisms 260*a-b* are configured and arranged to provide a desirable strength curve, and the components are shown to scale and in proper relation to one another in FIGS. 8-9. The gas springs 250*a-b* are designed to resist compression and/or to bias respective force transmitting members 240*a-b* toward the positions shown in FIGS. 8-9. The magnitude of the bias or resistance is a function of the effective connection locations between the second links 252*a-b* and respective force transmitting members 240*a-b*. More specifically, the magnitude of the bias or resistance decreases as the connection locations are moved closer to respective pivot axes TP (thereby decreasing the effective moment arms of the resistance mechanisms 260*a-b*).

Figure 13:
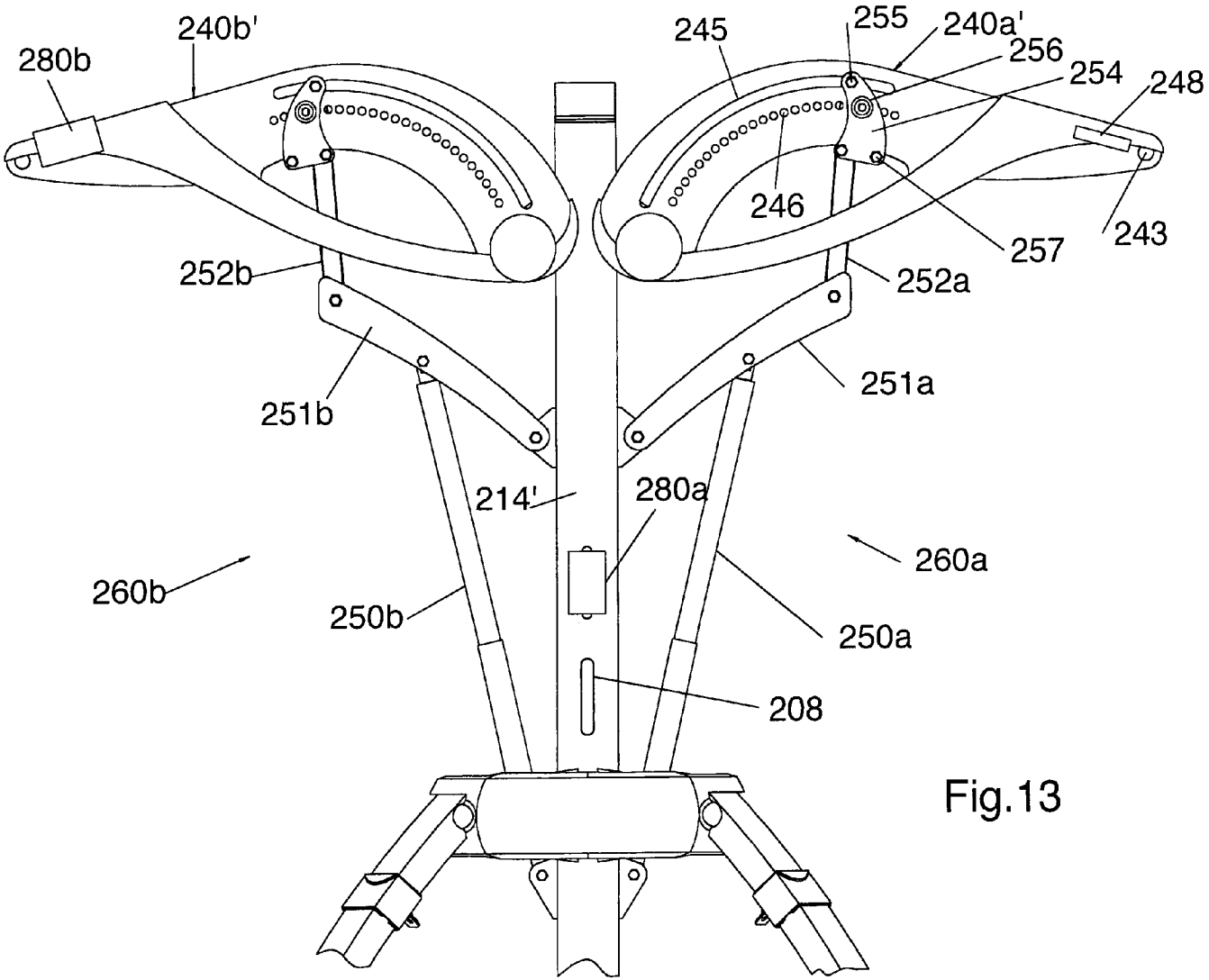
FIG. 13 is a front view of a portion of the exercise apparatus of FIG. 7 with an optional supplemental weight mounted thereon.
Figure 14:
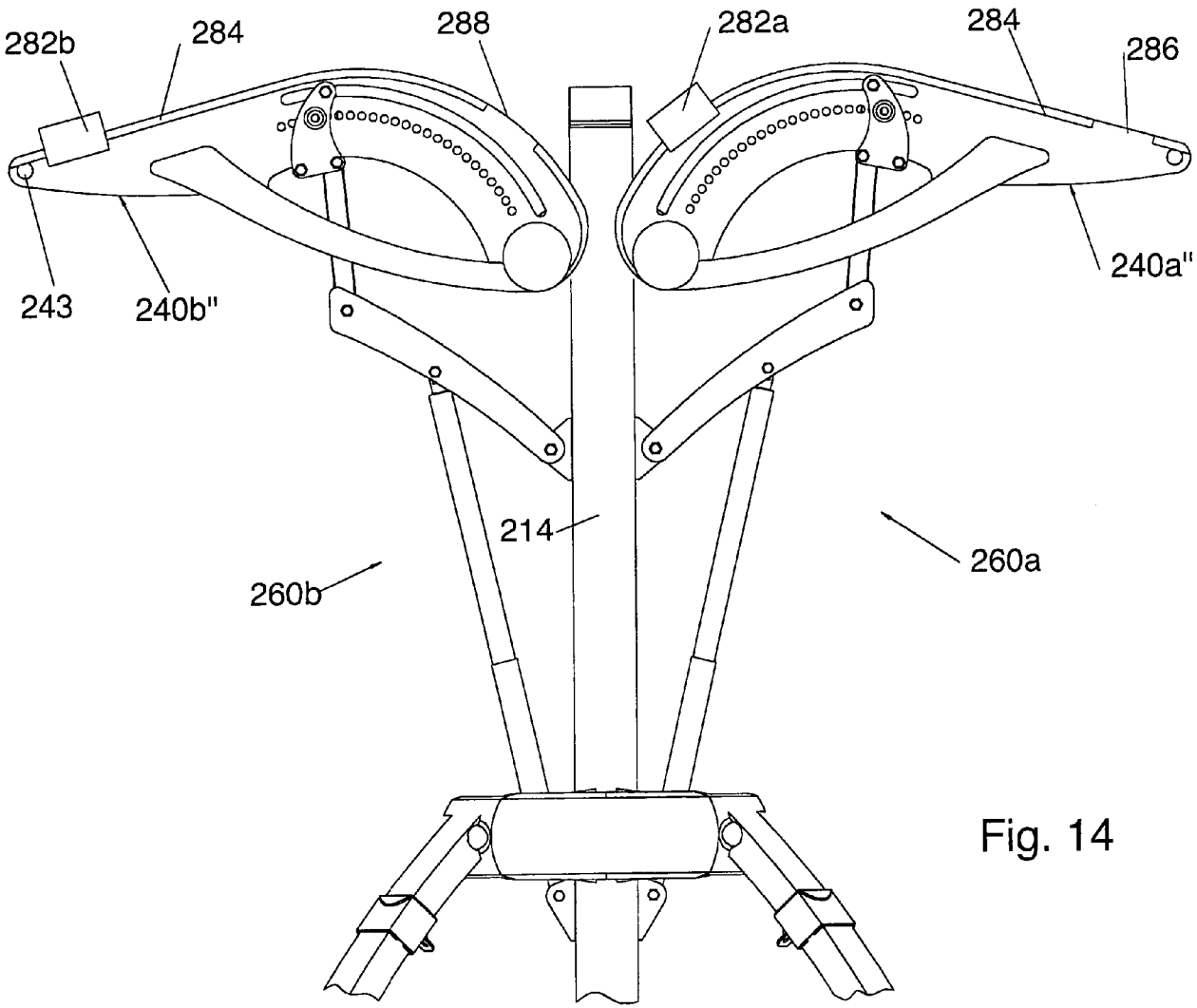
FIG. 14 is a front view of a portion of the exercise apparatus of FIG. 7 with another optional supplemental weight mounted thereon

The preferred means for adjusting resistance is shown in somewhat greater detail in FIGS. 13-14. With reference to the right side of the machine shown in FIG. 13, a bracket 254 is movably mounted on the force transmitting member 240*a*', and pivotally connected to the upper end of the second link 252*a*. A first stud 255 or other bearing member is mounted on an upper end of the bracket 254 and extends through a slot 245 in the force transmitting member 240*a*'. Also, second and third studs (one of which is designated as 257) are mounted on an opposite, lower end of the bracket 254 and bear against a lower edge of the force transmitting member 240*a*'. A plurality of holes 246 extend through the force transmitting member 240*a*' beneath the slot 245, and a spring-biased plunger 256 or other suitable fastener is inserted through the bracket 254 and an aligned one of the holes 246 to lock the bracket 254 in place relative to the force transmitting member 240*a*'. To reposition the bracket 254 along the force transmitting member 240*a*', a person simply pulls on the plunger 256, slides the bracket 254 toward the desired location, and releases the plunger 256 for entry into the desired hole 246. Indica is preferably provided in relation to the holes 246 to indicate the selected level of resistance.

FIG. 13 also shows a secondary means for adjusting resistance in the form of supplemental weights 280*a-b*. Each weight 280*a-b* is provided with an internal spring clip that is designed to snap about a rod 208 on the frame 214', and alternatively, to snap into an opening 248 on a respective force transmitting member 240*a-b*'. Each rod 208 is preferably U-shaped with opposite distal ends secured to the post 214'. The weight 280*a* is shown in a storage position on the frame, and the weight 280*b* is shown in an operative position on the force transmitting member 240*b*'. When positioned as shown on the respective force transmitting member 240*b*', the weight 280*b* reduces the amount of force required to move the force transmitting member 240*b*' downward (particularly at the beginning of the exercise stroke, where the force of gravity is acting generally perpendicular to the pivot axis TP).

FIG. 14 shows an alternative supplemental weight arrangement, wherein supplemental weights 282*a-b* are movable between respective operative positions proximate the distal ends of respective force transmitting members 240*a-b*", and respective storage positions proximate the pivot ends of respective force transmitting members 240*a-b*". In this arrangement, the weights 282*a-b* are slidably mounted on respective force transmitting members 240*a-b*" by means of respective rails or lips 284. As in the other arrangement, each weight 282*a-b* is provided with an internal spring clip. In this case, each clip is designed to snap into engagement with a notch 286 or 288 in a respective force transmitting member 240*a-b*" in order to lock the associated weight 282*a-b* in a desired position.

In each of the supplemental weight arrangements described above, the supplemental weights are preferably designed to reduce exercise resistance by one-half of the incremental force difference associated with adjacent holes 246. For example, if each hole 246 is associated with a five pound adjustment in force, then the supplemental weights are preferably configured to weigh two and one-half pounds each (thereby doubling the number of available resistance increments).

Figures 15A, 15B, 15C:
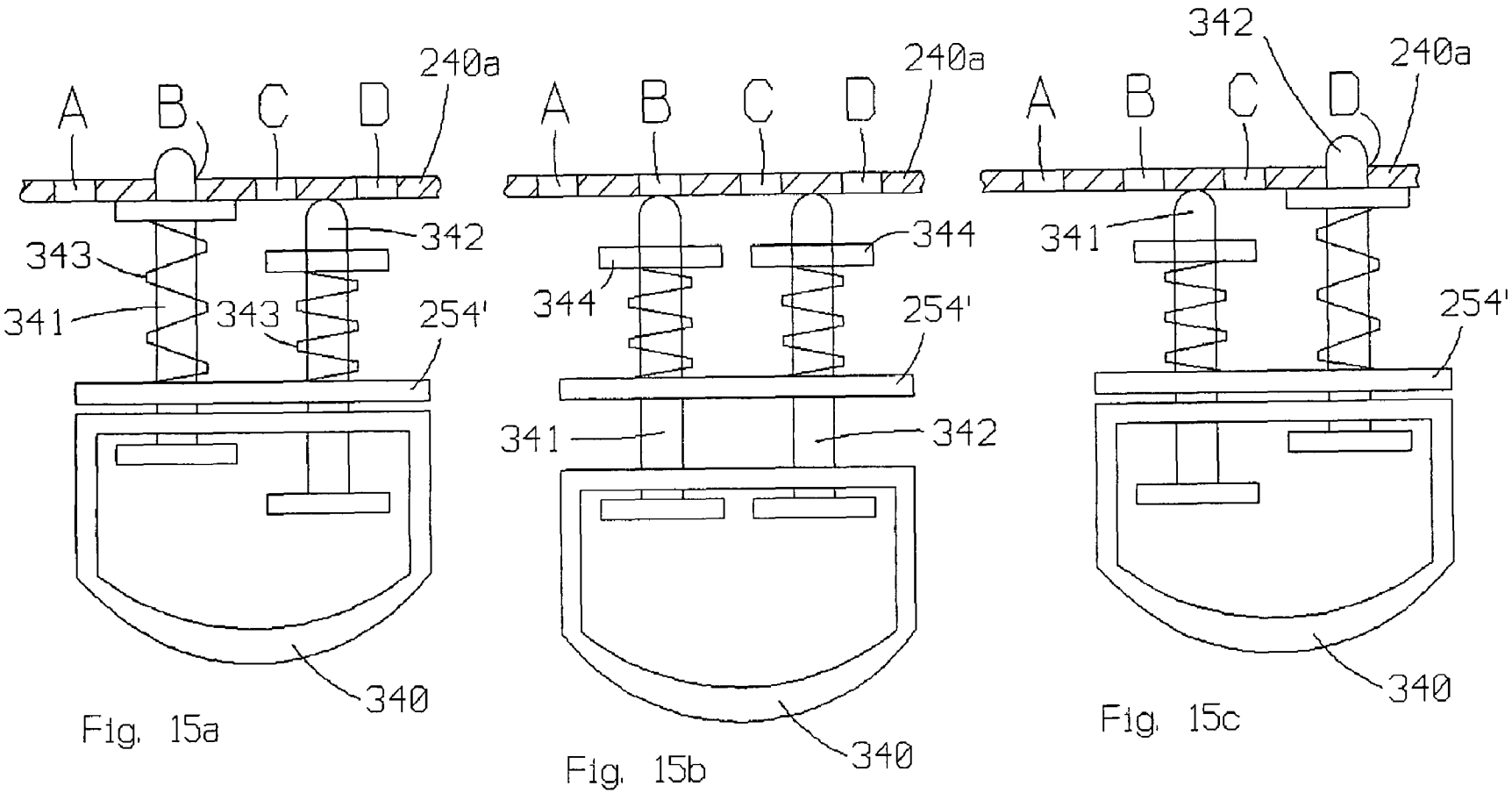
FIG. 15*a* is a partially sectioned top view of an adjustment arrangement suitable for use on the exercise apparatus of FIG. 7, and shown in a first position.
FIG. 15*b* is a partially sectioned top view of the adjustment arrangement of FIG. 15*a*, but shown in a second position.
FIG. 15*c* is a partially sectioned top view of the adjustment arrangement of FIG. 15*a*, but shown in a third position.

An alternative adjustment arrangement for the primary resistance mechanisms 260*a-b* is shown somewhat diagrammatically in FIGS. 15*a*-15*c*. The force transmitting member 240*a* is shown with holes A-D, which are a subset of the holes 246. A bracket 254' is secured to the force transmitting member 240*a* in much the same manner as the bracket 254 described above. First and second plungers 341 and 342 are inserted through respective holes in a handle 340, and through respective holes in the bracket 254'. Each plunger 341 and 342 has a lead end that is rounded and an opposite end that terminates in a relatively larger diameter head. A respective spring 343 is movably mounted on an intermediate portion of each plunger 341 and 342, and a respective nut 344 or other suitable fastener is fixably mounted on each plunger 341 and 342 to maintain a respective spring 343 in compression between a respective nut 344 and the bracket 254'. Additional guides or bushings may be provided on the bracket 254' to maintain the plungers 341 and 342 in proper alignment.

FIG. 15*a* shows the first plunger 341 engaged with the hole B in the force transmitting member 240*a*, and the second plunger 342 disposed between holes C and D. FIG. 15*b* shows the handle 340 pulled outward to remove the first plunger 341 from the hole B, and to maintain both plungers 341 and 342 out of engagement with the holes A-D. FIG. 15*c* shows the handle 340 moved to the right relative to the force transmitting member 240*a* and released by the user, thereby allowing the second plunger 342 to engage the hole D in the force transmitting member 240*a*, and leaving the first plunger 341 disposed between holes B and C. As suggested by the foregoing description, the spacing between the plungers 341 and 342 is one and one-half times the spacing between adjacent holes 246. As a result, the adjustment arrangement shown in FIGS. 15*a*-15*c* provides approximately twice as many resistance positions as there are holes 246 in the force transmitting member 240*a*, thereby providing relatively finer increments of resistance adjustment are available within a fixed amount of space.

Figure 7:
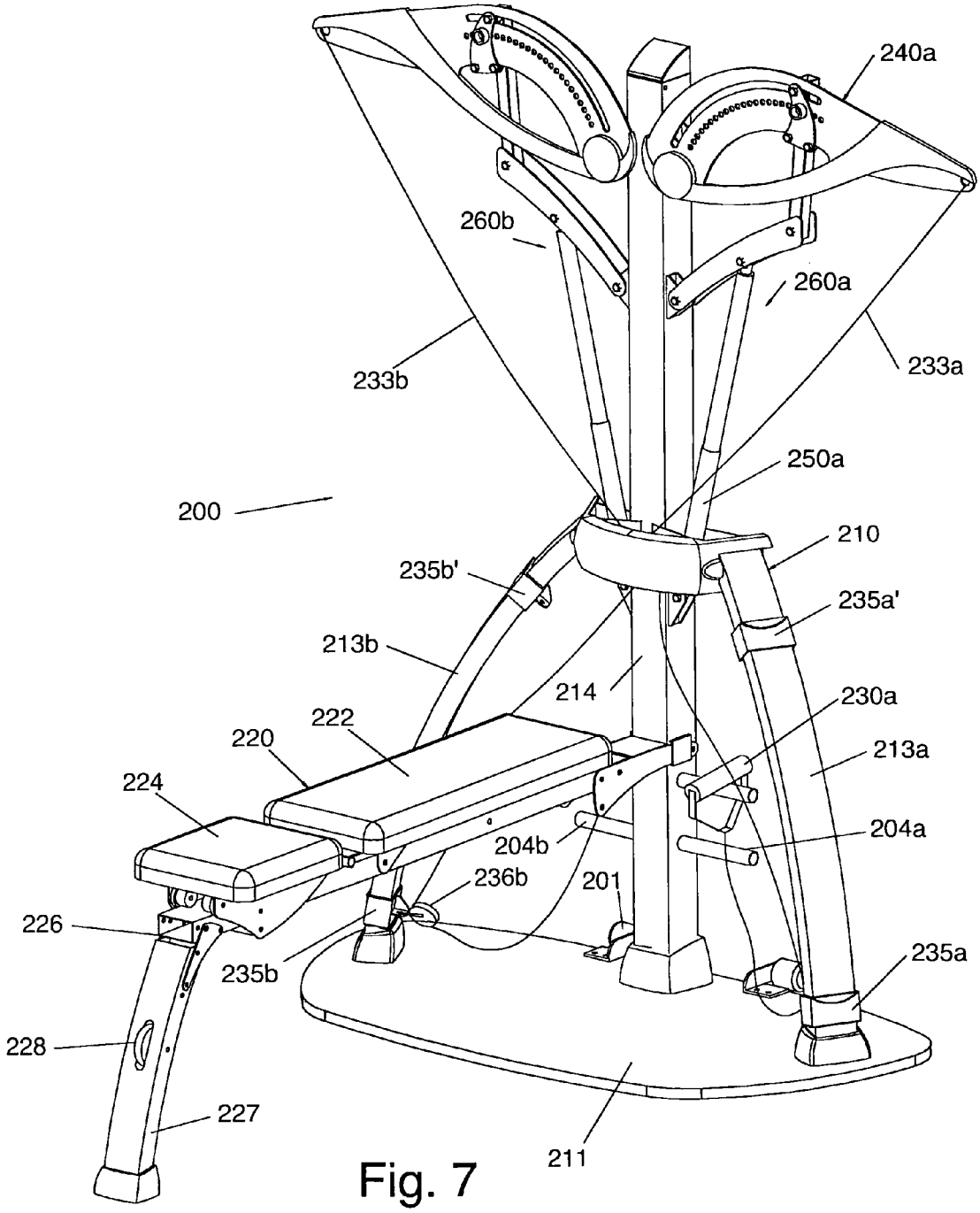
FIG. 7 is a perspective view of a second exercise apparatus constructed according to the principles of the present invention.

With reference back to FIGS. 7-11, each cord 233*a-b* extends from an upper distal end to a respective pulley 234 on the frame 210. As shown in FIG. 7, the pulleys 234 are rotatably mounted on respective sides of the post 214 and are disposed behind a shroud 202 that extends between the upper ends of the rails 213*a-b*. The cords 233*a-b* are routed from respective pulleys 234 to respective pulleys 236*a-b* on respective rails 213*a-b*. The pulleys 236*a-b* are rotatably mounted on respective collars 235*a-b*, which in turn, are slidably mounted on respective rails 213*a-b*. A detent pin 309 or other suitable fastener is inserted through a respective collar 235*a-b* and one of several alignable holes 216*a-b* in a respective rails 213*a-b* to lock the respective collar 235*a-b* in a desired position along a respective rail 213*a-b*. FIGS. 7-12 show the collars 235*a-b* in solid lines at respective positions proximate the base 211, and repositioned collars 235*a-b*' in dashed lines at respective positions proximate the upper ends of respective rails 213*a-b* and above the bench 220.

Each cord 233*a-b* extends from a respective pulley 236*a-b* to a distal end that is connected to a respective handle 230*a-b* or other suitable force receiving member, preferably by means of a carabiner or other suitable fastener. The handles 230*a-b* are shown supported on respective pegs 203*a-b* that project outward from respective sides of the post 214. Additional pegs 204*a-b* are disposed beneath the pegs 203*a-b* and similarly project outward from respective sides of the post 214.

The handles 230*a-b* may be pulled or pushed away from respective pulleys 236*a-b* to place respective cords 233*a-b* in tension and, if the tension is sufficient, to pivot respective force transmitting members 240*a-b* downward. By selectively repositioning the pulleys 236*a-b* relative to respective rails 213*a-b*, a person can person a variety of exercises on the apparatus 200. For example, with the collars 235*a-b* positioned as shown in FIGS. 7-12, a person can lie on the bench 220 and perform bench presses. Alternatively, a person can remove the bench 220 from the post 214, and perform dead lift exercises while standing on the platform 211. A person can also leave the rail 226 in place, remove the back support 222, unlock the seat 224, and adjust the collars 235*a-b* upward, preferably to the position of the collars 235*a-b*' shown in dashed lines, in order to perform rowing exercises (in which case, the person can rest his/her feet on the pegs 203*a-b* or the pegs 204*a-b*). Numerous other exercises can be performed, as well.

Figure 12:
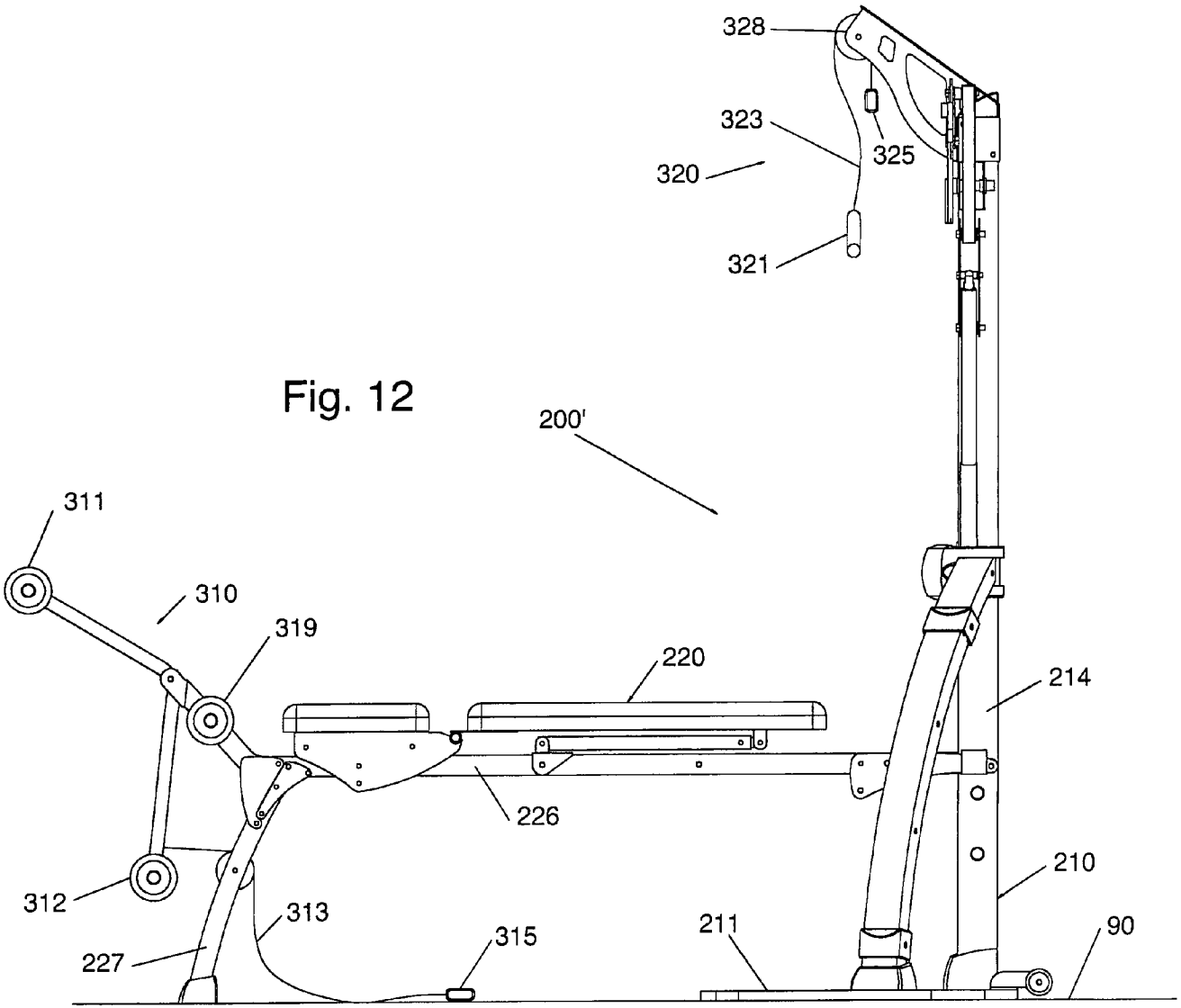
FIG. 12 is a side view of the exercise apparatus of FIG. 7 with certain optional accessories attached thereto.

Even more exercises can be facilitated by adding attachments to the apparatus 200 shown in FIGS. 7-11. For example, FIG. 12 shows a modified apparatus 200' that includes the apparatus 200 and two optional attachments. A first attachment is designated as 310 and may be removably attached to the end of the rail 226 to facilitate traditional leg extensions and leg curls. The attachment 310 includes a stationary member that supports a stationary support 319, which is preferably a foam covered cylinder. A generally L-shaped member is pivotally connected to a distal end of the stationary member, and respective moving supports 311 and 312 (also preferably foam covered cylinders) are mounted on respective distal ends of the L-shaped member. A cord or other flexible connector 313 is routed through the slot in the leg 227, and a first distal end of the cord 313 is connected to the L-shaped member proximate the padded support 312. A carabiner 315 or other suitable fastener is connected to an opposite, second distal end of the cord 313 to facilitate attachment of the cords 233*a-b* thereto (thereby selectively linking the leg attachment 310 to one or both of the resistance mechanisms 260*a-b*). As noted above, the handles 230*a-b* are preferably releasably connected to the distal ends of respective cords 233*a-b* by means of respective carabiners to accommodate removal of the handles 230*a-b*, as desired.

The second attachment is designated as 320 and may be removably attached to the top of the post 214 to facilitate traditional pull down and/or press down exercises. The second attachment 320 includes a stationary member having an upper distal end that rotatably supports a pulley 328. A cord or other flexible connector 323 is routed about the pulley 328, and a first distal end of the cord 323 is connected to a force receiving member 321, which is shown as a bar having left and right hand grips, but alternatively could be the handles 230*a-b*. Another carabiner 325 or other suitable fastener is connected to an opposite, second distal end of the cord 323 to facilitate attachment of the cords 233*a-b* thereto (thereby selectively linking the overhead attachment 320 to one or both of the resistance mechanisms 260*a-b*). As noted above, the handles 230*a-b* are preferably releasably connected to the distal ends of respective cords 233*a-b* by means of respective carabiners to accommodate removal and/or relocation of the handles 230*a-b*, as desired.

The foregoing description and accompanying figures disclose specific embodiments and/or particular applications of the present invention. However, this disclosure will enable those skilled in the art to derive additional embodiments, variations, and/or applications. For example, different types of known resistance devices may be substituted for the gas springs without departing from the scope of the present invention. Also, the features of respective embodiments may be mixed and matched in various ways. For example, the number of available resistance levels may be increased by combining the methods used on the respective embodiments. Moreover, the supplemental weight arrangements may be used with other types of primary resistance mechanisms. In view of the foregoing, the scope of the present invention should be limited only to the extent of the following claims.

What is claimed is:

1. An exercise apparatus, comprising:

a frame configured to rest on a floor surface;

at least one body support connected to the frame and configured to support a person during exercise activity;

a left force transmitting member and a right force transmitting member, wherein each said force transmitting member is pivotally connected to the frame;

a left resistance assembly and a right resistance assembly, wherein each said resistance assembly is interconnected between the frame and a respective said force transmitting member, and each said resistance assembly defines a respective pivot point;

a left adjustment means for adjusting the left resistance assembly relative to the left force transmitting member, wherein the left adjustment means is selectively repositioned along an arcuate path that is (a) defined by the left force transmitting member, and (b) centered about a respective said pivot point;

a right adjustment means for adjusting the right resistance assembly relative to the right force transmitting member, wherein the right adjustment means is selectively repositioned along an arcuate path that is (a) defined by the right force transmitting member, and (b) centered about a respective said pivot point;

a left force receiving member and a right force receiving member; and a left flexible connector and a right flexible connector, wherein each said flexible connector is routed between a respective said force receiving member and a respective said force transmitting member.

2. The exercise apparatus of claim 1, wherein the left flexible connector is routed about at least two pulleys on the frame.

3. The exercise apparatus of claim 2, wherein at least one of the pulleys is selectively repositionable along the frame.

4. The exercise apparatus of claim 1, wherein each said resistance assembly includes a respective gas spring.

5. The exercise apparatus of claim 4, wherein each said adjustment means includes a pin configured for insertion into one of several holes disposed along a respective said arcuate path.

6. The exercise apparatus of claim 1, wherein each said resistance assembly is pivotally connected to the frame at a first height above the floor surface, and each said force transmitting member is pivotally connected to the frame at a relatively greater, second height above the floor surface.

7. The exercise apparatus of claim 6, wherein the left flexible connector is routed about a pulley mounted on the frame at a third height above the floor surface, and the third height is less than the first height.

8. The exercise apparatus of claim 1, wherein each said adjustment means includes a pin configured for insertion into one of several holes disposed along a respective said arcuate path.

9. The exercise apparatus of claim 1, further comprising a leg curl assembly mounted on the frame, wherein at least one said flexible connector is routed about at least one pulley on the frame and connected to the leg curl assembly.

10. The exercise apparatus of claim 1, further comprising a lat pull-down assembly mounted on the frame, wherein at least one said flexible connector is routed about at least one pulley on the frame and connected to the lat pull-down assembly.

11. The exercise apparatus of claim 1, wherein the at least one body support includes a seat.

12. The exercise apparatus of claim 1, wherein the at least one body support includes a back support.

13. The exercise apparatus of claim 1, wherein each said resistance assembly includes a respective gas spring that is arranged to remain unaffected during operation of a respective said adjustment means.

14. The exercise apparatus of claim 1, wherein each said resistance assembly includes a respective gas spring, and each said adjustment means operates without encountering resistance from a respective said gas spring.

15. The exercise apparatus of claim 1, wherein each said adjustment means includes two pins configured for alternating, mutually exclusive insertion into one of several holes disposed along a respective said arcuate path.

16. An exercise apparatus, comprising:

a frame configured to rest on a floor surface;

at least one body support connected to the frame and configured to support a person during exercise activity;

a left force transmitting member and a right force transmitting member, wherein each said force transmitting member is pivotally connected to the frame;

a left resistance assembly and a right resistance assembly, wherein each said resistance assembly is interconnected between the frame and a respective said force transmitting member, and each said resistance assembly defines a respective pivot point;

a left pin and a right pin, wherein each said pin is selectively interconnected between a respective said resistance assembly and a respective said force transmitting member at one of several holes disposed along an arcuate path that is (a) defined by a respective said force transmitting member, and (b) centered about a respective said pivot point;

a left force receiving member and a right force receiving member; and a left flexible connector and a right flexible connector, wherein each said flexible connector is routed between a respective said force receiving member and a respective said force transmitting member.

17. The exercise apparatus of claim 16, wherein each said flexible connector is routed about at least one pulley that is selectively repositionable along the frame.

18. A method of facilitating a plurality of exercises, comprising the steps of:

providing a frame configured to rest on a floor surface;

connecting at least one body support to the frame to support a person during exercise activity;

pivotally connecting left and right force transmitting members to the frame;

interconnecting left and right resistance assemblies between the frame and respective said force transmitting members;

providing left and right force receiving members;

using left and right flexible connectors to link respective said force receiving members and respective said force transmitting members;

providing left and right pulleys on the frame;

routing the flexible connectors about respective said pulleys; and selectively repositioning the pulleys along the frame.

19. The method of claim 18, further comprising the step of selectively adjusting the resistance assemblies by pivoting at least respective portions thereof through respective arcuate paths that are (a) defined on respective said force transmitting members (b) and centered about respective pivot points defined by the pivoting of said at least respective portions.

20. The method of claim 19, wherein the adjusting step involves insertion of left and right pins into respective left and right holes that are aligned with respective said arcuate paths.

* * * * *